US007703219B2

(12) United States Patent
Beck

(10) Patent No.: US 7,703,219 B2
(45) Date of Patent: Apr. 27, 2010

(54) SHOE INNER SOLE

(75) Inventor: Hermann Beck, Pirmasens (DE)

(73) Assignee: CAPRICE Schuhproduktion GmbH & Co. KG, Pirmasens (DE)

( * ) Notice: Subject to any disclaimer, the term of this patent is extended or adjusted under 35 U.S.C. 154(b) by 658 days.

(21) Appl. No.: 11/710,704

(22) Filed: Feb. 26, 2007

(65) Prior Publication Data

US 2007/0234593 A1 Oct. 11, 2007

Related U.S. Application Data

(63) Continuation-in-part of application No. 10/450,866, filed as application No. PCT/EP01/08848 on Jul. 31, 2001, now abandoned.

(30) Foreign Application Priority Data

Aug. 4, 2000 (DE) ..... 100 38 216

(51) Int. Cl.
*A43B 13/38* (2006.01)

(52) U.S. Cl. ..... 36/44; 36/43; 36/147; 36/3 B

(58) Field of Classification Search ..... 36/43, 36/44, 71, 141, 147, 3 B
See application file for complete search history.

(56) References Cited

U.S. PATENT DOCUMENTS

| | | | | | |
|---|---|---|---|---|---|
| 989,894 | A | | 4/1911 | Bryne | |
| 1,128,220 | A | | 2/1915 | Bullard | |
| 2,090,881 | A | * | 8/1937 | Wilson | 36/29 |
| 2,358,342 | A | * | 9/1944 | Margolin | 36/147 |
| 4,215,492 | A | * | 8/1980 | Sandmeier | 36/44 |
| 4,268,980 | A | | 5/1981 | Gudas | |
| 4,345,387 | A | | 8/1982 | Daswick | |
| 4,461,099 | A | | 7/1984 | Bailly | |
| 5,022,168 | A | | 6/1991 | Jeppson, III et al. | |
| 5,493,791 | A | * | 2/1996 | Kramer | 36/28 |
| D373,013 | S | * | 8/1996 | Rosetta | D2/961 |
| 5,619,809 | A | * | 4/1997 | Sessa | 36/3 R |
| 5,685,094 | A | * | 11/1997 | Lin | 36/141 |
| 5,896,680 | A | | 4/1999 | Kim et al. | |
| 6,026,599 | A | | 2/2000 | Blackwell et al. | |
| 6,076,282 | A | | 6/2000 | Brue | |
| 6,138,383 | A | * | 10/2000 | Steinke et al. | 36/44 |

(Continued)

FOREIGN PATENT DOCUMENTS

DE 3635831 A1 5/1988

(Continued)

*Primary Examiner*—Jila M Mohandesi
(74) *Attorney, Agent, or Firm*—D. Peter Hochberg; Sean F. Mellino; Daniel J. Smola

(57) ABSTRACT

An inner sole for a shoe, the inner sole having a heel portion, a mid-area portion, a metatarsal portion, a metatarsal/toe transition portion and a toe portion. Force absorbing, compressible blisters, each having a perforation, extend across the heel portion, the mid-area portion and the metatarsal portion. There are truncated blisters in the metatarsal portion and no blisters in the toe portion. Orifices are disposed between the blisters and truncated blisters, and are in the toe portion. The orifices dissipate moisture from a user's foot. Also disclosed is a shoe arrangement including the foregoing inner sole, and layers including a breathable and/or moisture permeable layer and a fluid-absorbing layer.

34 Claims, 8 Drawing Sheets

U.S. PATENT DOCUMENTS

| | | | | |
|---|---|---|---|---|
| 6,434,859 | B1 | 8/2002 | Kim | |
| D474,331 | S * | 5/2003 | Dean | D2/961 |

FOREIGN PATENT DOCUMENTS

| | | | |
|---|---|---|---|
| DE | 3732495 | A1 | 9/1988 |
| DE | 8900237.7 | | 5/1989 |
| DE | 9407864 | U | 7/1994 |
| DE | 9407864.5 | | 8/1994 |
| EP | 0916274 | A1 | 5/1999 |
| WO | WO 99/66812 | | 12/1999 |

* cited by examiner

SHOE INNER SOLE

CROSS REFERENCE TO RELATED APPLICATION

This application is a continuation-in-part of U.S. patent application Ser. No. 10/450,866 filed on Feb. 17, 2004, now abandoned which is the U.S. National Phase of PCT/EP2001/08848 filed Jul. 31, 2001 which claims priority of German S/N 100 38 216.9 filed Aug. 4, 2000.

BACKGROUND OF THE INVENTION

1. Field of the Invention

The present invention relates to an inlay sole or inner sole for a shoe, in particular a sports, leisure or climbing shoe and/or boot.

2. Background of the Art

In the prior art there is described, for example in DE-A-37 32 495, an intermediate sole for a shoe which has an inlay and a peripheral part. A number of solid supporting elements extend downward from a base of the inlay. The supporting elements are of such a height that they correspond to the rise or elevation of the peripheral part from the tip of the foot to the heel. The damping' properties of the inlay are intended to be adaptable to the respective weight of the user, in that an appropriately selected inlay is inserted into the shoe. However, this inlay sole continues to leave something to be desired with regard to its damping properties and wearing comfort.

DE-A-36 35 831 describes an outsole for footwear with a sole surface on the foot side into which a uniform recess is introduced. Inserted flush into the recess is a blistered sheet. The blistered sheet comprises a base sheet which bears closely and regularly distributed blisters, with intermediate spaces remaining between the blisters. The upper sides of the blisters are preferably curved and are covered by a cover sheet. According to one embodiment, the blisters are hollow and have openings on the upper side.

DE-U-89 00 237 describes an inner sole with an upper side which is formed by a base sheet with a multiplicity of blisters regularly distributed on it, a layer facing the sole of the foot, made of a material such as leather or textile, and also a perforation. This layer is applied to the rear side of the base sheet, facing away from the blisters, and the tops of the blisters are connected to the sole.

BRIEF SUMMARY OF THE INVENTION

It is an object of the present invention to provide an improved inner sole for a shoe which allows, in particular, individually adaptable damping properties and improved wearing comfort of the shoe.

The invention is in this case based on the fundamental idea of providing the inner sole with a number of hollow protuberances in the form of blisters, which are provided substantially over the entire sole area where relative high forces occur, on its underside. The blisters are provided to damp the relatively high forces where they occur, and are reduced or eliminated where the forces need not be damped, usually in the area of the sole. The inner sole and blisters are formed in one process step. For this purpose, either a single material is used for the entire sole construction or a number of different materials are used for different regions of the sole. Both variants permit optimal adaptation of the inner sole according to the invention to a foot of a wearer of a shoe provided with this sole, with optimal damping properties being achieved at the same time.

To achieve the object described above, the invention is also based on the fundamental idea of providing an inner sole with blister-like protuberances which point away from an underside of a foot of a wearer of a shoe provided with the inner sole according to the invention, the inner sole having perforations, at least in certain portions. These perforations may be provided in the intermediate space between the individual blisters, through the blisters or both in the intermediate spaces and in the blisters. The perforations serve in particular for dissipating moisture, such as perspiration for example, from the foot of the wearer of the shoe (i.e., the perforations desiccate the sole near the foot of the wearer). In particular in the case of the perforated blisters, an effect similar to a pump occurs during use of a shoe provided with the inner sole according to the invention, with the effect that the moisture is dissipated from the foot in a particularly advantageous way. An absorption/damping layer can be provided between the inner sole and the outer sole.

A combination of the two basic principles described above of the inner sole according to the invention produces an inner sole which can be formed or adapted optimally to the shape of a user's foot, which at the same time permits optimal wearing comfort. It is in this respect advantageous in particular that the inner sole according to the invention has blisters which, independently of one another and each by themselves, provide a "cushion effect" or damping effect and also ventilation with every step. These advantageous effects are where the relatively high forces occur, wherefore the blisters are not present in the toe area of the sole, and preferably have a reducing size in the transitional area between the full blister area and the missing blister area. However, the ventilating and water dissipating perforations preferentially exist over the entire sole area, facing downwardly or away from the foot. The result is a continuous adaptation of the inner sole according to the invention to every step and every shape of foot of a user. In this case, the foot remains optimally cooled and is individually damped in a particularly advantageous way. The inner sole according to the invention is described below on the basis of a preferred embodiment with reference to the accompanying drawings, in which:

A preferred aspect of the invention relates to an inner sole having a heel portion, a mid-area portion, a metatarsal portion, a metatarsal/toe transition portion and a toe portion. Downwardly facing perforated blisters are dispersed in the heel portion, the mid-area portion and the metatarsal portion of the inner sole. Truncated blisters having progressively shortened walls extending towards the toe portion, and orifices without blisters are dispersed in the toe portion. There can also be an arch portion having orifices but no blisters. The blisters damp forces applied to the blisters, and the perforations and orifices dissipate moisture.

DETAILED DESCRIPTION OF THE INVENTION

Figure 1:
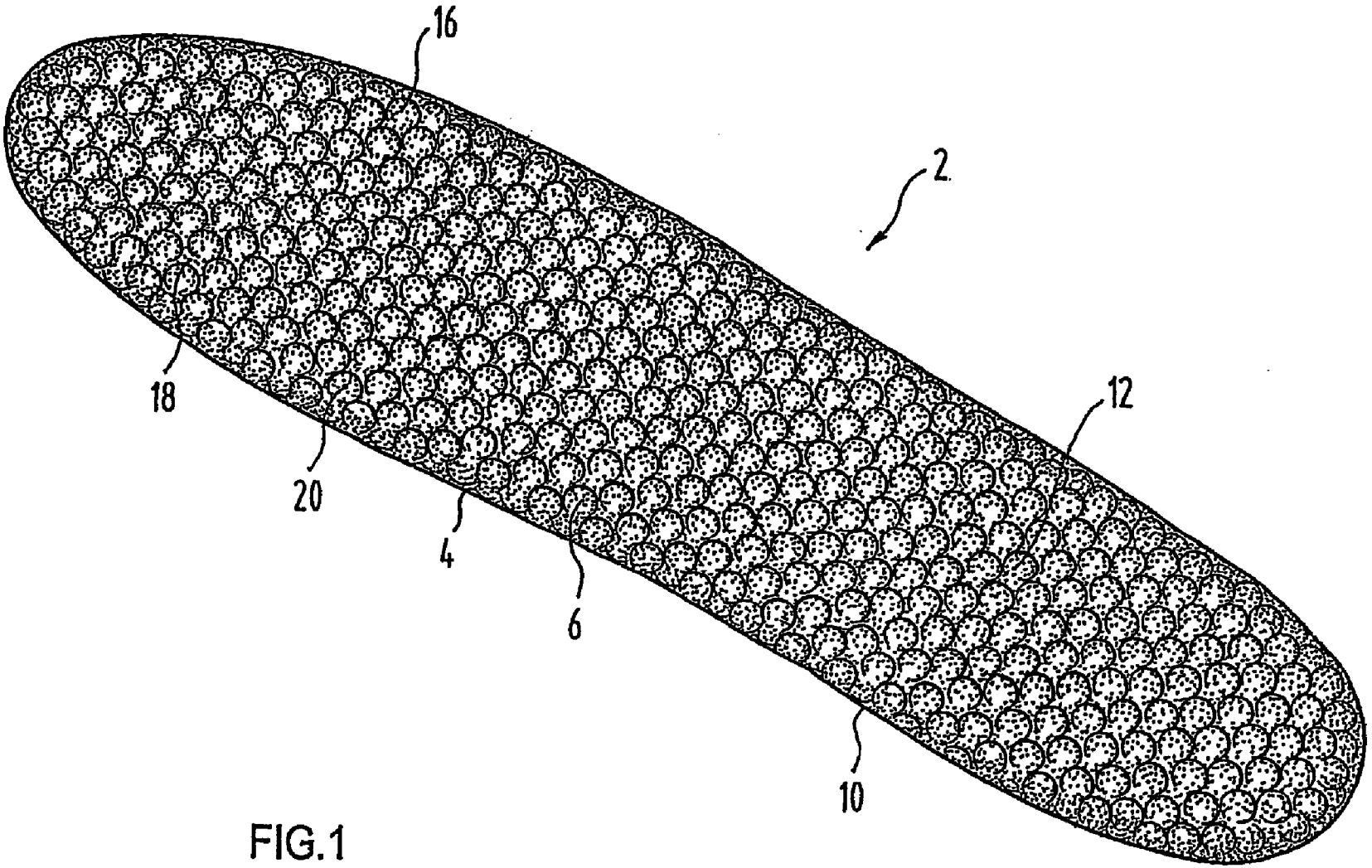
FIG. 1 shows a schematic representation of the inner sole according to the invention from below.
Figure 2:
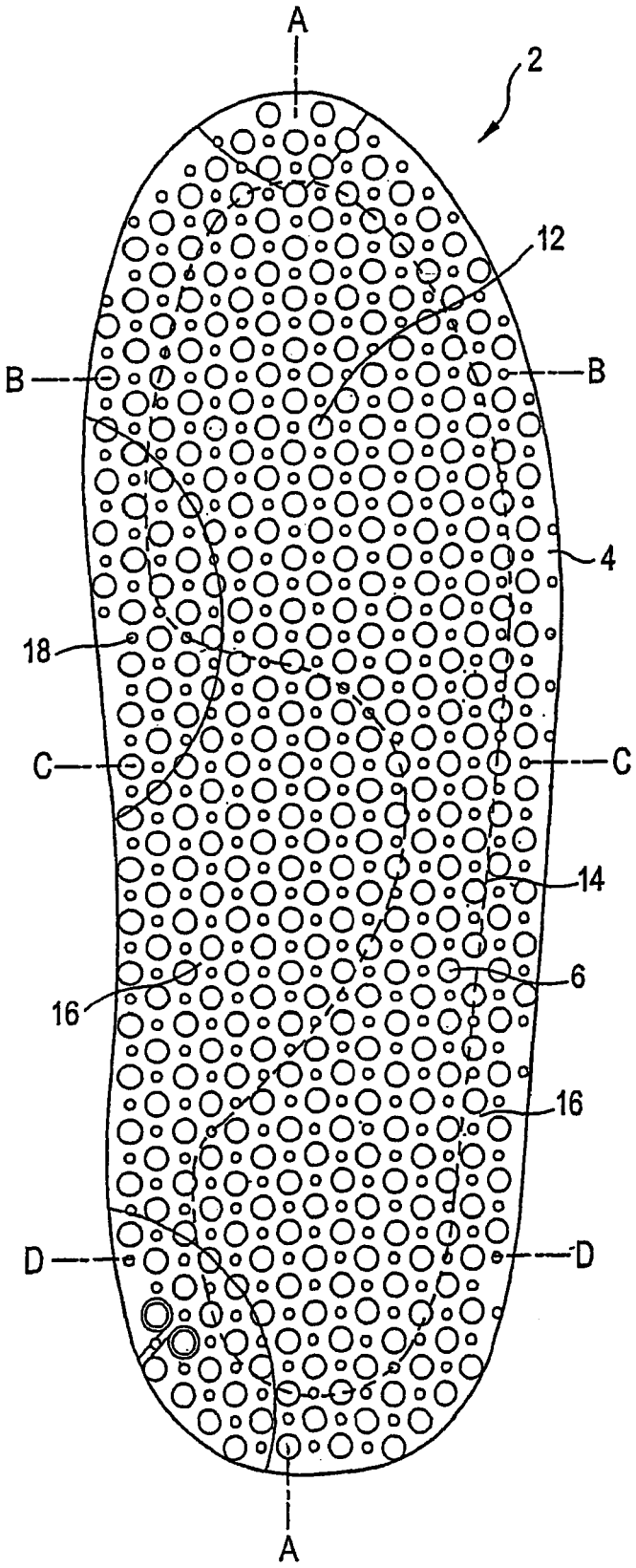
FIG. 2 shows a view from below of the inner sole according to the invention.
Figure 3:
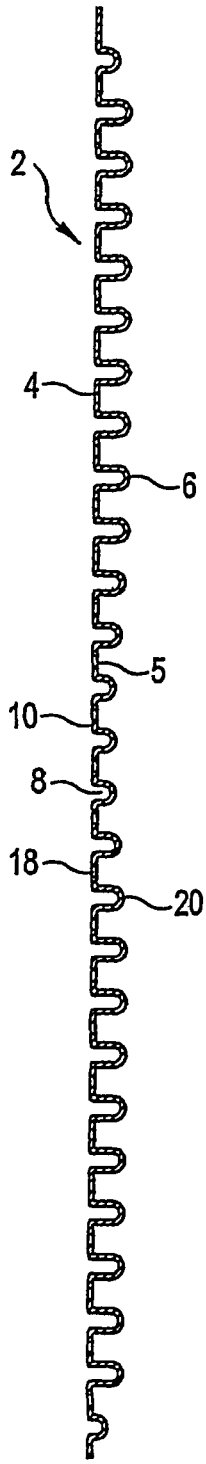
FIG. 3 shows a section along the line A-A in FIG. 2.
Figure 4:
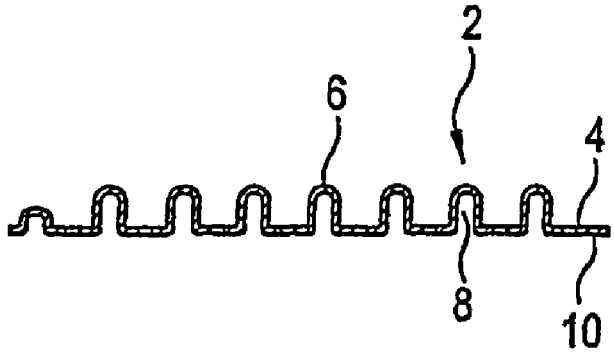
FIG. 4 shows a section along the line B-B in FIG. 2.
Figure 5:
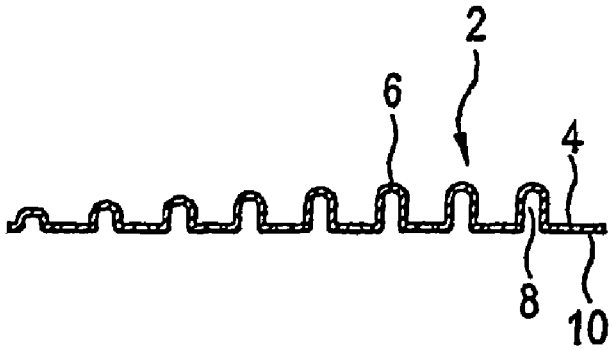
FIG. 5 shows a section along the line C-C in FIG. 2.
Figure 6:
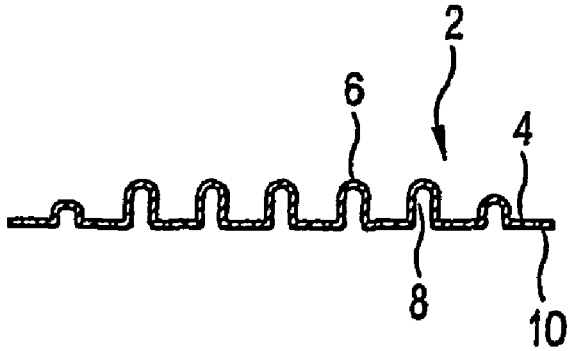
FIG. 6 shows a section along the line D-D in FIG. 2.

The inner sole 2 according to one embodiment of the invention is shown in more detail in FIGS. 1 to 6 and substantially has a sole base 4 and a multiplicity of protuberances 6 in the form of blisters formed integrally with it. The protuberances or blisters 6 are preferably formed substantially over the entire underside of the inner sole 2, or at least beneath the foot of a wearer, with an inside edge beneath the arch of a wearer's foot being devoid of blisters as discussed below edge. The blisters 6 are preferably positioned relatively close to one another, so that an only small distance of, for example, 0.3 to 3 mm, preferably of 0.4 to 1.0 mm, and particularly preferably of about 0.5 mm, is provided between the individual blisters 6. The blisters 6 preferably have a regular arrangement, for example in the form of a close packing. As shown in FIG. 2, in this case the shortest distance between the blisters is provided in the diagonal direction of the sole 2.

According to the preferred embodiment represented in the figures, the blisters 6 have a hollow space, which is open toward the upper side 10 of the sole. The form of the blisters may be substantially the same in a central region 12, which is schematically shown in FIG. 2 by a dashed line 14, while particularly the height of the blisters, and consequently also the diameter, may vary in an edge region 16 outside the line 14. In this region, the blisters are preferably lower and have a smaller diameter. The blisters 6 may be formed differently both in the central region 12 and in the edge region 16, in a way corresponding to the sectional representations of FIGS. 3 to 6. The central region 12 may also be chosen such that only the outermost blisters 6 along the entire periphery of the sole are respectively formed lower. The blisters 6 provided in the central region 12 preferably have at their base an outside diameter of between 6.5 and 7.5 mm, preferably about 7 mm, an inside diameter of between 4.5 and 5.5 mm, preferably about 5 mm, and a wall thickness in the range between 0.9 and 1.3 mm, preferably between 1.0 and 1.2 mm. The wall thickness preferably diminishes from the base of the blisters 6 to their dome-shaped end, so that, for example, the wall thickness at the base is 1.2 mm and in the region of the dome is 1.0 mm. The height of the blisters 6 lies, for example, between 3 and 10 mm, preferably between 5 and 8 mm and particularly preferably at about 6 mm. In the edge region 16 of the inner sole 2, the blister height may also be lower, however, in a way corresponding to the statements made above, and be, for example, only a few tenths of a millimeter. The thickness of the base 4 of the inner sole 2 lies, for example, between 0.5 and 1.5 and preferably between 0.8 and 1.2 mm.

The wall thicknesses, heights, diameters and/or materials of the blisters or of the entire inner sole may vary in ranges, in order in particular to be adapted to various shapes of foot, dimensions, types of stress or uses. The hardness of the material used usually lies in the range between 35 and 60, preferably between 40 and 45 Shore A. Coming into consideration as materials are, for example, elastomers, latex, block copolymers, thermoelastics, rubbers, in particular thermoplastic rubbers (TPR), synthetic rubbers and natural rubbers. For selecting the suitable material, it, is important that it has adequate hardness and adequate rubber-elastic characteristics at the temperature at which it is used. Particularly preferred are latex materials and thermoplastic rubbers (TPR).

Described below is a further embodiment of the present invention, which not only can be combined with the first embodiment described above, as for example schematically shown in FIG. 2, but also achieves the object on which the invention is based independently of the first embodiment.

Figure 7:
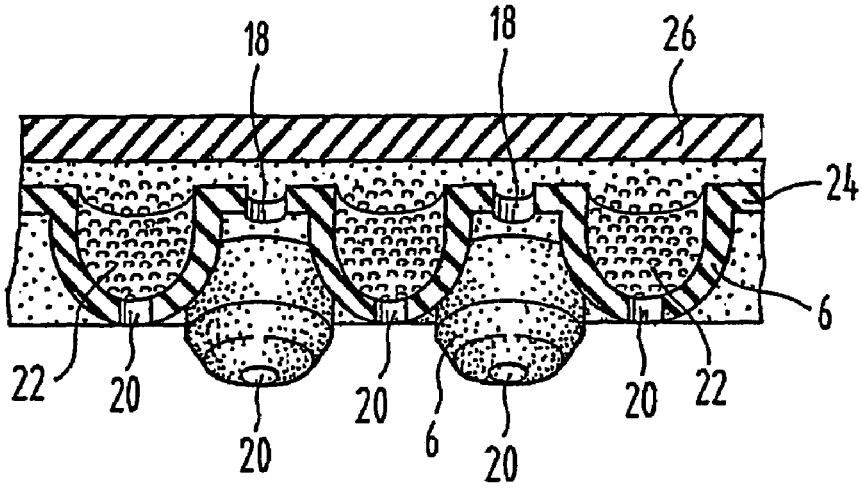
FIG. 7 shows an enlarged, perspective and partly sectioned representation of the blisters of the inner sole according to the invention.
Figure 8:
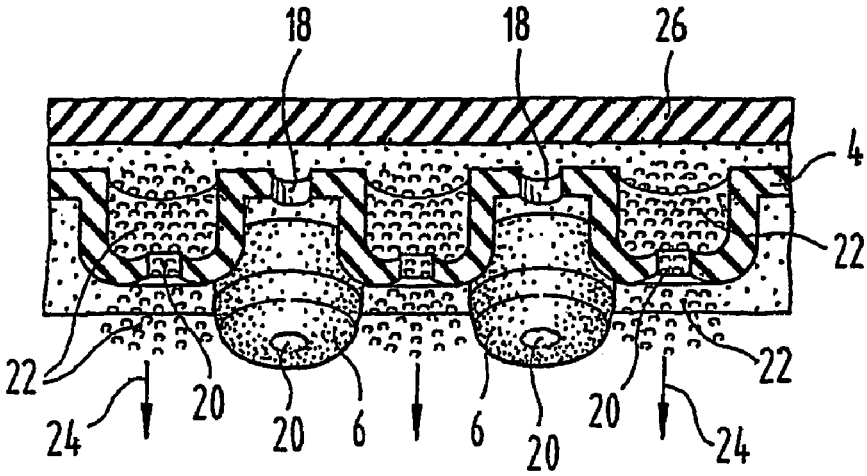
FIG. 8 shows a perspective, partly sectioned representation similar to FIG. 7, fluid dissipated from the foot of a user by perforations being schematically represented.

According to this embodiment, the sole 2 according to the invention has in an intermediate region between the blisters 6 and/or in the blisters 6 themselves perforations 18 or 20, by which dissipation or removal of fluid is possible in particular, but also by which the damping properties or the shock-absorbing effect is further improved. The diameters of the perforations are, for example, between 1 and 3.5 mm, preferably between 1.6 and 2.8 mm. In this respect, it may be particularly preferred to form the diameters of the perforations 18 in the base 4 of the inner sole according to the invention with a greater diameter than the perforations 20 in the blisters 6. The perforations 20 on the blisters 6 are preferably formed in the region of the tip of the dome, so that the opening formed by the perforation is provided at the lowest point. In FIGS. 7 and 8, the inner sole 2 according to the invention is represented in detail, with the removal or dissipation of fluid 22 being shown there in detail. As represented in FIG. 8, the moisture or fluid produced or present in a shoe (not represented), for example perspiration, is dissipated through the perforations 18 and 20 away from the user's foot in the direction of the arrows 24, the compressing of the blisters 6 producing a pumping effect. Preferably provided underneath the inner sole 4 is a fluid-absorbing layer (not represented), with which the fluid 22 removed can be absorbed. The contour of this layer preferably corresponds to that of the inner sole, so that the inner sole 2 and the fluid-absorbing layer lie substantially completely one on top of the other. Once the user has taken off the shoe, the fluid can evaporate out of the cushion in the reverse direction, in a direction counter to the arrows 24, through the perforations 18 and 20, so that the shoe dries out again.

This embodiment of the shoe according to the invention permits both an optimal damping effect and optimal ventilation or fluid dissipation. The definitions according to the first embodiment of the inner sole according to the invention, described with reference to FIGS. 1 to 6, also apply equally to the second embodiment of the inner sole 2 according to the invention, described in particular with reference to FIGS. 7 and 8. The same applies with regard to the selection of material.

The production of the inner sole 2 according to the invention preferably takes place by injection molding or compression molding of material, so that the base 4 and the blisters 6 of the inner sole 2 according to the invention can be integrally formed. In addition, the perforations 18 and 20 can already be formed at the same time in the molding step during production. According to a preferred embodiment, the inner sole 2 is provided as an integral element, consisting of different materials. For example, materials with a greater hardness may be integrated in the region of the heel and the ball of the foot than the remaining region of the sole during the production step.

Figure 9:
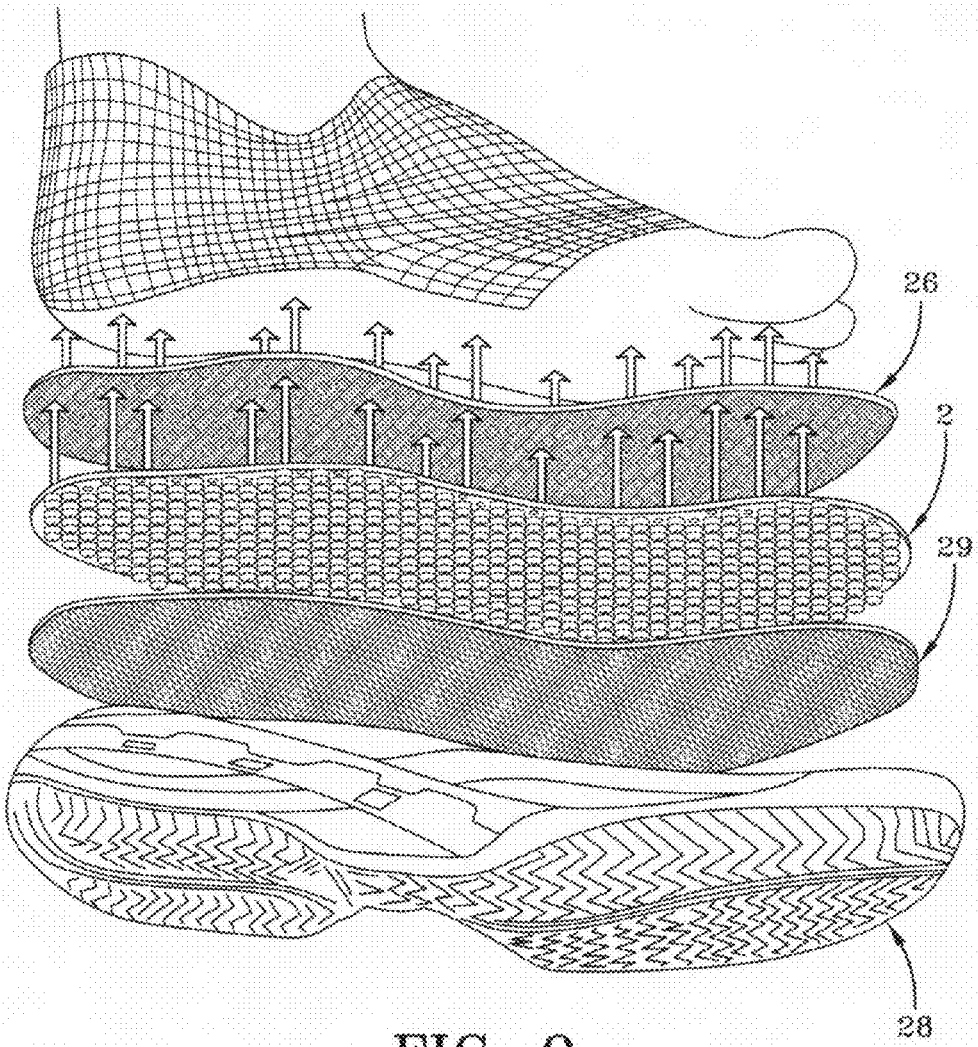
FIG. 9 shows a spatial representation of a sole construction with the inner sole according to the invention under a user's foot.

As represented in FIGS. 7 to 9, a breathable and/or moisture-permeable layer 26 is preferably applied to the upper side 10 of the inner sole 2 according to the invention. Knitted fabrics, nonwovens, cotton or polyester are suitable for example for this layer, what is known as a knitted spacer fabric being used with particular preference. This knitted spacer fabric is preferably produced from a single yarn and, as a result, is particularly breathable and moisture-permeable. The knitted spacer fabric is preferably produced from a polyester material. The connection between the upper side 10 of the sole 2 according to the invention and the breathable and/or moisture-permeable layer 26 can be produced, for example, by adhesive bonding. A layer of woven fabric (not represented in the figures), which forms the surface of the inner sole, may also be applied on the layer 26. The material for the inner sole 2 and/or the layer 26 may advantageously also have antibacterial material additives. Also schematically represented in FIG. 9 is an outer sole or outsole 28. The outsole 28 is arranged underneath the inner sole 2, the blisters 6 of the inner sole 2 being directed toward the outer sole 28. Disposed between layer 26 and outer sole 28 is a fluid-absorbing layer 29, which can also provide a damping effect.

Figure 10:
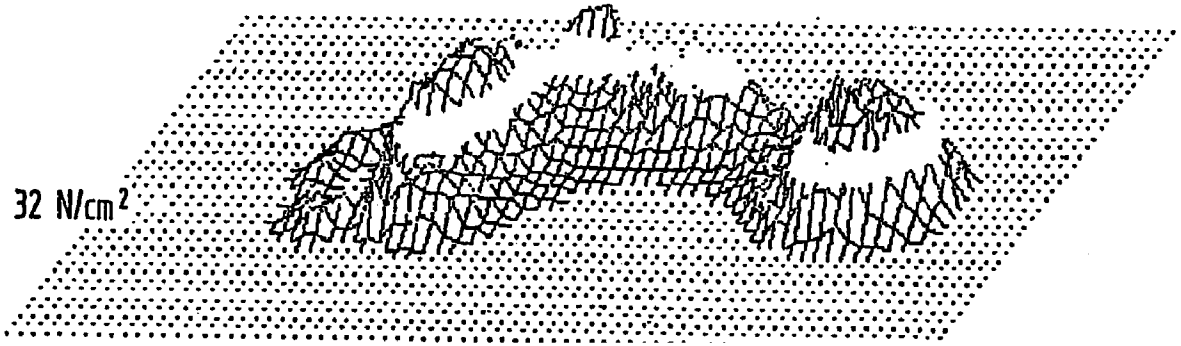
FIG. 10 shows a diagram of the pressure distribution on the foot of a user of a shoe with the inner sole according to the invention.
Figure 11:
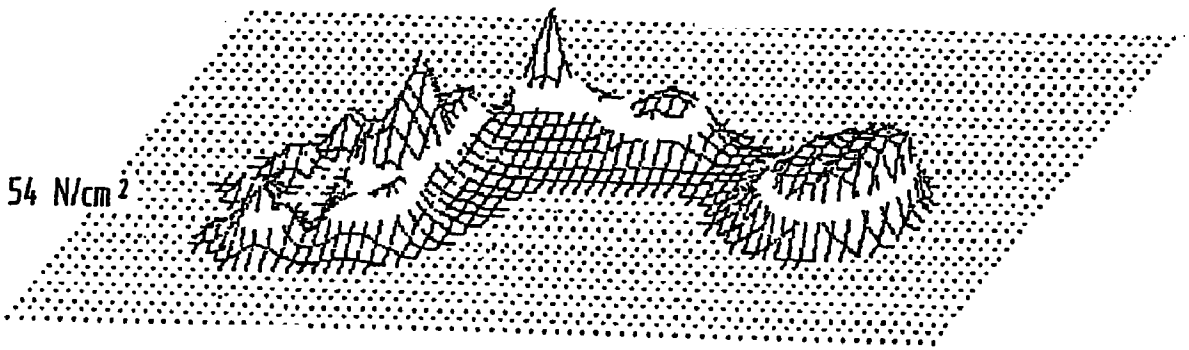
FIG. 11 shows a diagram of the pressure distribution on the foot of a user in the shoe according to FIG. 10 without the inner sole according to the invention.

Represented in FIGS. 10 and 11 are diagrams which show the pressure distribution which act on the underside of a user's foot when the shoe has the inner sole 2 according to the invention (FIG. 10) and when the shoe is worn without the sole according to the invention (FIG. 11). These diagrams were determined in the course of orthopedic investigations. The investigation took place with an emed-SF platform with 4 sensors per $cm^2$ from the Novel company. 15 tests were carried out with test persons and the mean values were evaluated. Both a measurement under the shoe (platform measurement) and a measurement under the foot (in-shoe measurement) were performed. It was found in the platform measurement that the relatively wide heel levers the heel of the foot inward, the increased initial pronation being accommodated very well by the medial heel. As a result, the line of gait can be set in an appropriate direction. The heel-to-toe motion via the outer side of the foot and via the big toe takes place as desired. The conclusion to be drawn is that the overall stabilization of the heel is favorable and the initial pronation is great to very great. The pressure distribution determined in the in-shoe measurement according to FIGS. 10 and 11 is represented as a 3D pressure profile. The shape of the foot can be clearly seen from this. The maximum pressure occurs under the metatarsal capitula of the foot and is evident in particular in FIG. 11 from the two peaks. The peaks of this 3D profile according to FIG. 11 can be effectively accommodated by the inner sole 2 according to the invention and the foot can be loaded over a wider surface area, as shown in FIG. 10. Since the damping properties are determined by the loading, the damping is all the better the higher the loading. The inner sole according to the invention adapts to the loading, is consequently always optimally matched to the wearer, in particular its sportsman. Differently loaded regions of the foot are bedded independently of one another, whereby the foot is optimally supported.

Figure 12:
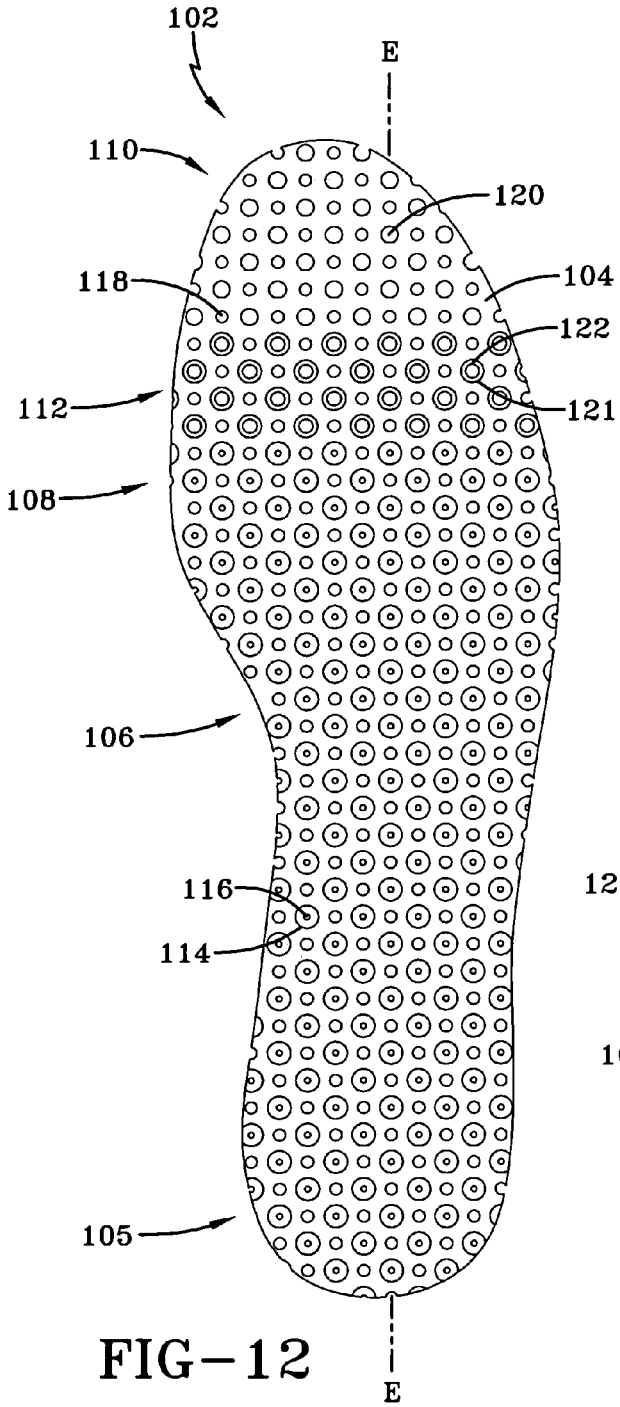
FIG. 12 shows a view from below the inner sole according to a preferred embodiment of the invention.

Another embodiment of the inner sole is shown in FIG. 12, which shows the underside of an inner sole 102. Inner sole 102 includes a sole base 104, a heel portion 105, a mid-area portion 106, a metatarsal portion 108, a toe portion 110 and a metatarsal/toe transition portion 112. A series of blisters 114 having perforations 116, similar to blisters 6 with perforations 20, are evenly provided in heel portion 105, mid-area portion 106 and metatarsal portion 108. Blisters 114 preferably have a height in the range of 4-6 mm, and most desirably at 5 mm. The blisters cannot be too high because this could lead to instability of the foot as it rests in inner sole 102. Blisters 114 damp forces applied to the respective blisters, and blisters 114 with their respective perforations 116 act as a pump to desiccate or remove moisture from the area around the bottom of a foot pressing on the inner sole 102 as the blisters 114 are compressed and return to their original shape. Perforations 116 in blisters 114 should be small enough to effect the damping by blisters 114 as they are compressed, and not to large to severely reduce or eliminate the damping effect. Perforations 116 should not exceed 2 mm in diameter.

Perforations 118 are similar to perforations 18 described with respect to the embodiment shown in FIGS. 1-6, being uniformly spaced between respective blisters 114 and extending through base 104. Perforations 118 dissipate moisture away from the user's foot.

Figure 13:
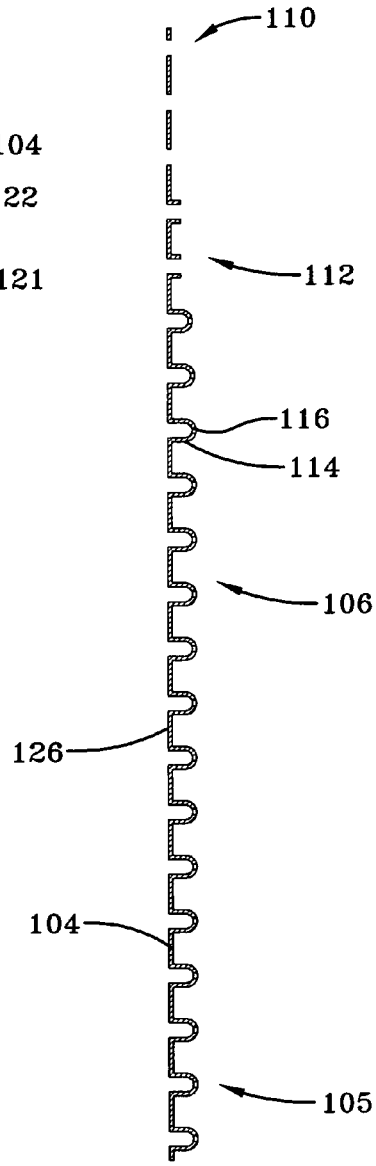
FIG. 13 shows a section along the line AA in FIG. 12.

Referring to toe portion 110, this portion does not have blisters 114, rather, large orifices 120 advantageously having the same diameters as the base of the blisters 114 are shown, which are interspaced with perforations 118. Orifices 120 can advantageously be the base parts of blisters 114 which have been removed such as by cutting or shearing using an automatic tool in the course of the manufacture of inner sole 102, since this could be a cheaper and faster way to produce orifices than by processes involving complicated molds and molding techniques. The absence of blisters in toe portion 110 is desirable since the user of the shoe often needs room for his or her toes to move about, and shock absorbing is not required in the toe portion 110 as it is in a metatarsal portion 108 or heel portion 105. The lack for forces occurring in toe portion 110 is indicated in the force diagram of FIGS. 10 and 11. However metatarsal/toe transition portion 112 is characterized by a tapering off of the heights of blisters 114 from the full height in metatarsal portion 108 to the absence height of orifices 120. This can be seen in FIG. 13, which is a section taken along the line E-E in FIG. 12, where inner sole 102 includes blisters 114 in heel portion 105, mid-area portion 106 and metatarsal portion 108. Perforations 118 are not shown in FIG. 13 (nor are perforations 6 shown in FIGS. 4-6). However, in metatarsal/toe portion 112, walls 121 of blisters 114 become progressively shorter, and a set of truncated blisters 122 exist in metatarsal/toe portion 112. Truncated blisters 122 are not blisters, and they do not relieve the forces applied to them. Respective orifices 120 of truncated blisters 122 transfer moisture from the toes, which like the user's foot, engage the upper side or face 126 of inner sole 102 (or the layer applied to it) since the walls of blisters 114 are truncated blisters 122 all extend downwardly, opposite from upper side 126.

Figure 14:
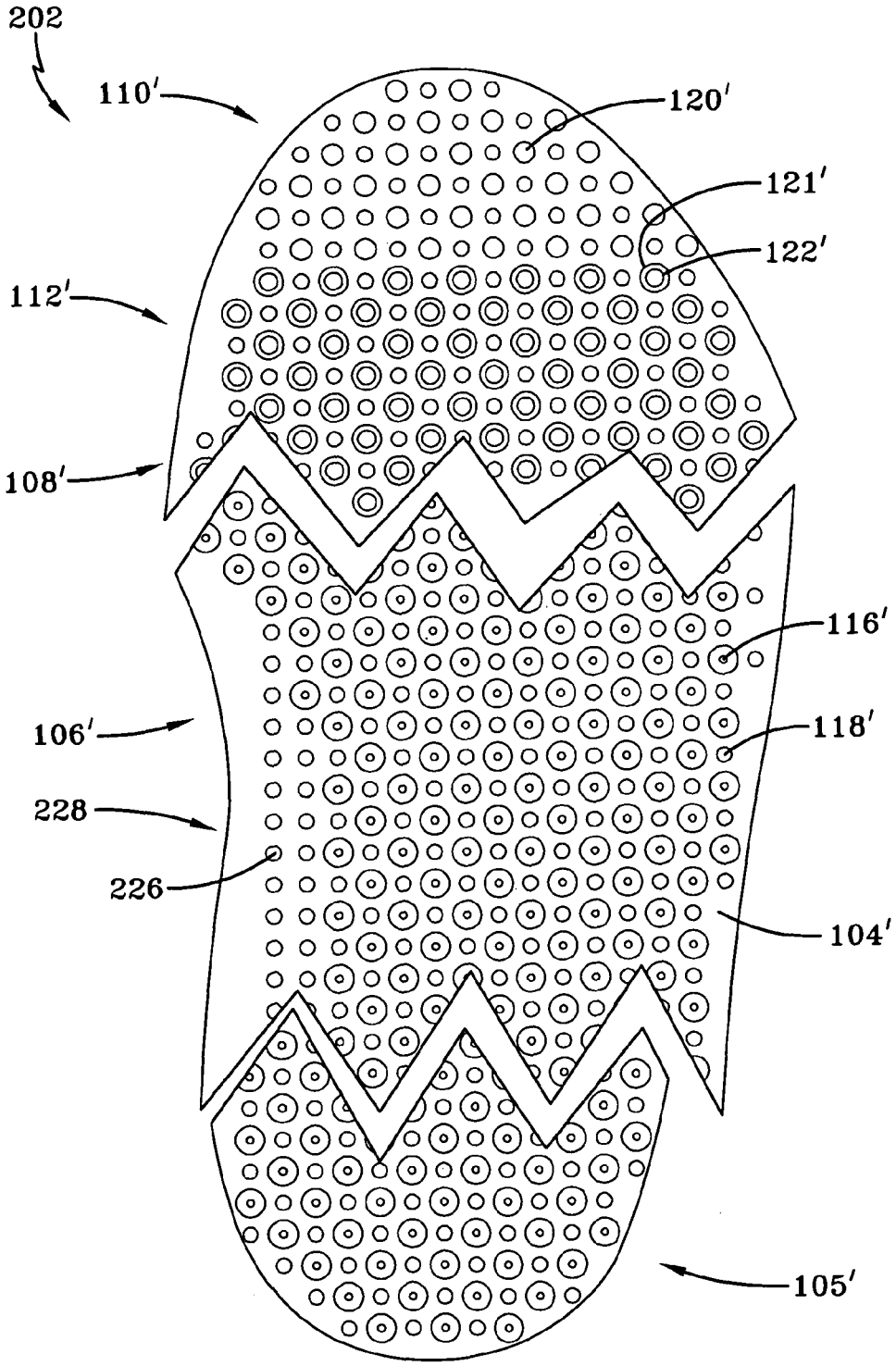
FIG. 14 shows a view from below the inner sole according to another preferred embodiment of the invention.

A similar inner sole 202 is shown in FIG. 14, shown in shortened form. Innersole 202 has the same features shown in FIGS. 12 and 13, and the features are indicated by the same numerical indicators used in FIGS. 12 and 13, such as base 104', heel portion 105', mid-area portion 106', metatarsal portion 108', metatarsal/toe transition portion 112', toe portion 110', blisters 114', perforations 116' and 118', orifices 120', shortened walls 121' and truncated blisters 122'. However, inner sole 102 also has orifices 226 extending through base 104' in areas of inner sole 202 in which blisters 114' are missing, particularly in an arch area 228 of inner sole 222, for increasing the desiccating effect of inner sole 202 on the user's feet.

Inner soles 102 and 202 are preferably used with the same cooperative members as was the embodiment shown in FIGS. 1-6. Thus, inner soles 102 and 202 would have breathable and/or moisture permeable layer 26 preferably applied to their respective upper sides (upper side 126 in FIGS. 11 and 12), which rest on the upper part of outsole 28. It is often preferable to have fluid absorbing layer 29 between layers 26 and outsole 28.

The invention has been described as relating to shoes. The term "shoes" refers to most types of footwear, including dress shoes, sport shoes, athletic shoes, sneakers, sandals, boots (ski boots, hiking boots, snow mobile boots, football boots, soccer boots, climbing boots, etc.), slippers and dance shoes.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. An elastic inner sole for a shoe having an outer sole, said inner sole having a rearward heel end and a forward toe end, said inner sole comprising:

a heel portion;

a mid-area portion extending forwardly from a said heel portion;

a metatarsal portion extending forwardly from a said mid-area portion;

a metatarsal/toe transition portion extending forwardly from said metatarsal portion;

a toe portion extending forwardly from said metatarsal/toe transition portion;

a base disposed throughout said inner sole, said base having an upper side facing a user's foot and a lower side facing the outer sole;

a plurality of compressible blisters provided on the lower side of said base in each of said heel portion, said mid-area portion and said metatarsal portion of said inner sole, said blisters comprising:

a dome-shaped structure having a perforation in said dome; and an orifice in said base, said dome-shaped structure extending downwardly from each of said orifices;

said blisters being compressed when forces are applied to said respective orifices for absorbing some of said forces and said blisters returning to an initial condition upon relief of the forces, said blisters further dissipating moisture through a pumping action as said blisters are compressed and returned towards the initial condition;

orifices in the toe portion of said inner sole, said toe portion being devoid of blisters; and truncated blisters in said metatarsal/toe transition portion, said truncated blisters having orifices and walls extending from the periphery of the respective orifices, said walls being lower than the dome structure of said blisters;

said blisters absorbing forces applied by a user's foot to said heel portion, said mid-area portion and said metatarsal portion of said inner sole, and the lack of blisters in said toe portion enabling the user's toes to move around in said toe portion.

2. An inner sole according to claim 1 and further including perforations extending through said base between said respective blisters and orifices for dissipating moisture away from a user's foot.

3. An inner sole according to claim 1 and further including said perforations on areas of said inner sole where there are no blisters.

4. An inner sole according to claim 1 and further including an arch portion located beneath the position of the arch of a user's foot when positioned on said inner sole, said arch portion having an area devoid of blisters but including perforations for dissipating moisture from a user's foot.

5. An inner sole according to claim 1 wherein said walls of said truncated blisters being progressively shorter from the rearward part of said metatarsal/toe transition portion towards the forward part of said toe position.

6. An inner sole according to claim 1 wherein said blisters have a height of between 4 mm and 6 mm.

7. An inner sole according to claim 6 wherein said blisters have a height of 5 mm.

8. An inner sole according to claim 1 wherein said perforations have a diameter not exceeding 2 mm.

9. An inner sole according to claim 1 wherein said dome-shaped blisters are separated from each other by a distance in the range of 0.3 mm to 3 mm.

10. An inner sole according to claim 9 wherein said dome-shaped blisters are separated from the nearest of the other adjacent blisters at said base by a distance of 1 mm.

11. An inner sole according to claim 1 wherein said blisters separated from each other by a distance in the range of 0.3 mm to 3 mm.

12. An inner sole according to claim 1 wherein said blisters are separated from each other by a distance in the range of 0.4 mm to 1 mm.

13. An inner sole according to claim 1 wherein said blisters are separated from each other by a distance of about 0.5 mm.

14. An inner sole according to claim 1 wherein said blisters have outer diameters within the range of 6.5 mm and 7 mm.

15. An inner sole according to claim 1 wherein said blisters have an outer diameter of about 7 mm.

16. An inner sole according to claim 1 wherein said blisters have inside diameters within the range of 4.5 mm to 5.5 mm.

17. An inner sole according to claim 1 wherein said blisters have an inside diameter of about 5 mm.

18. An inner sole according to claim 1 wherein said blisters each have a wall with a wall thickness in the range of 0.9 mm to 1.3 mm.

19. An inner sole according to claim 1 wherein said blisters each have a wall with a wall thickness in the range of 1.0 mm to 1.2 mm.

20. An inner sole according to claim 1 wherein said dome-shaped blisters comprises a substantially cylindrical base portion and a dome end portion adjoining said base portion, wherein the wall thickness in the base portion is about 1.2 mm and the wall thickness in the dome is about 1.0 mm.

21. An inner sole according to claim 1 wherein said blisters have a height in the range of 3 mm to 10 mm.

22. An inner sole according to claim 1 wherein said blisters have a height in the range of 5 mm to 8 mm.

23. An inner sole according to claim 1 wherein said blisters have a height of about 6 mm.

24. An inner sole according to claim 1 wherein said sole base has a thickness in the range of 0.5 mm and 1.5 mm.

25. An inner sole according to claim 1 wherein said sole base has a thickness in the range of 0.8 mm to 1.2 mm.

26. An inner sole according to claim 1 wherein said perforations passing through said blisters have a diameter in the range of 1 mm to 3.5 mm.

27. An inner sole according to claim 1 wherein said perforations passing through said blisters have a diameter in the range of 1.6 mm and 2.8 mm.

28. A shoe sole arrangement having an upper direction facing a user's foot when said shoe arrangement is in a shoe and an opposing downward direction, said shoe sole arrangement comprising:

an elastic inner sole for a shoe having an outer sole, said inner sole having a rearward heel end and a forward toe end, said inner sole comprising:

a heel portion;

a mid-area portion extending forwardly from a said heel portion;

a metatarsal portion extending forwardly from a said mid-area portion;

a metatarsal/toe transition portion extending forwardly from said metatarsal portion;

a toe portion extending forwardly from said metatarsal/toe transition portion;

a base extending throughout said inner sole, said base having an upper side facing a user's foot and a lower side facing the outer sole;

a plurality of compressible blisters provided on the lower side of said base in each of said heel portion, said mid-area portion and said metatarsal portion of said inner sole, said blisters comprising:

a dome-shaped structure having a perforation in said dome, and an orifice in said base, said dome-shaped structure extending downwardly from each of said orifices;

said blisters being compressed when forces are applied to said respective orifices for absorbing some of said forces and said blisters returning to an initial condition upon relief of the forces, said blisters further dissipating moisture through a pumping action as said blisters are compressed and returned towards the initial condition of said respective blisters;

orifices in the toe portion of said inner sole, said toe portion being devoid of blisters;

truncated blisters in said metatarsal/toe transition portion, said truncated blisters having orifices and walls extending from the periphery of the respective orifices, said walls being lower than the dome structure of said blisters;

said blisters absorbing forces applied by a user's foot to said heel portion, said mid-area portion and said metatarsal portion of said inner sole, and the lack of blisters in said toe portion enable the user's toes to move around in said toe portion;

a breathable and moisture permeable layer disposed upwardly of said inner sole; and an elastic fluid-absorbing layer disposed downwardly of said inner sole.

29. A shoe arrangement according to claims 27 wherein said fluid-absorbing layer is bonded to said inner sole.

30. A shoe arrangement according to claim 27 wherein said breathable and moisture permeable layer is bonded to said inner sole.

31. A shoe arrangement according to claim 27 and further including an absorption/damping layer disposed between said inner sole and the outer sole.

32. A shoe arrangement according to claim 27 wherein said inner sole further includes perforations extending through said base between said respective blisters and orifices for dissipating moisture away from a user's foot.

33. A shoe arrangement according to claim 6 wherein said inner sole further includes said perforations or areas of said inner sole where there are no blisters.

34. An inner sole according to claim 1 and further including an arch portion located beneath the position of the arch of a user's foot when positioned on said inner sole, said arch portion having an area devoid of blisters but including perforations for dissipating moisture from a user's foot.

* * * * *